US005624179A

United States Patent [19]

Korte

[11] Patent Number: 5,624,179

[45] Date of Patent: Apr. 29, 1997

[54] LAMP FOR FLUORESCENT TUBES

[76] Inventor: Heinrich Korte, Am Rennschloot, DE-26810 Ihrhove, Germany

[21] Appl. No.: 399,713

[22] Filed: Mar. 3, 1995

[51] Int. Cl.[6] ..... F21S 3/00

[52] U.S. Cl. ..... 362/222; 362/226; 362/260; 362/374; 362/394; 200/539

[58] Field of Search ..... 362/221, 222, 362/223, 224, 226, 260, 217, 362, 374, 394; 200/538, 539, 540

[56] References Cited

U.S. PATENT DOCUMENTS

| | | | |
|---|---|---|---|
| 335,548 | 2/1886 | Thomson | 200/540 |
| 669,151 | 3/1901 | Trumbull | 200/549 |
| 2,117,782 | 5/1938 | Aldinger | 200/538 |
| 4,074,122 | 2/1978 | Moore | 362/223 |
| 4,287,456 | 9/1981 | Kovacik et al. | 362/221 |
| 5,420,764 | 5/1995 | Hussain et al. | 362/226 |

FOREIGN PATENT DOCUMENTS

| | | | |
|---|---|---|---|
| 233529 | 8/1987 | European Pat. Off. . | |
| 68986 | 8/1958 | France | 362/221 |
| 3400489 | 7/1985 | Germany . | |
| 2091862 | 8/1982 | United Kingdom . | |

*Primary Examiner*—Denise Gromada
*Assistant Examiner*—Alan B. Cariaso
*Attorney, Agent, or Firm*—Keck, Mahin & Cate

[57] ABSTRACT

A lamp for fluorescent tubes with a housing (2) of plastic consisting of two half-shells (9,10) that can be divided laterally, a plug element (3) molded out of the housing (2), an illumination field with possibly an illumination field cover (5), as well as the electrical equipment necessary for operating the fluorescent tube (12), has a switching element (7) guided through the housing (2) which can be held in place in the desired switching position by a catch element (19) provided on the housing (2) (FIG. 1).

24 Claims, 11 Drawing Sheets

LAMP FOR FLUORESCENT TUBES

FIELD OF THE INVENTION

The invention pertains to a lamp for fluorescent tubes with a housing consisting of two half-shells of plastic, a plug element molded out of the housing, an illumination field that may, if desired, have an illumination field cover, as well as the electrical equipment needed for operating the fluorescent tube.

BACKGROUND OF THE INVENTION

Fluorescent lamps or lamps for fluorescent tubes are being used more and more frequently in place of conventional filament lamps since they have a longer service life and are more economical in their consumption of energy. Moreover, it is possible in a simple manner to obtain light of any desired color, particularly; light similar to daylight, with the aid of fluorescent lamps. Because of the advantages of fluorescent lamps it has become common to equip work spaces and storehouses with them. Such fluorescent lamps are generally configured as extended and firmly mounted ceiling lights.

Fluorescent lamps have also been developed that are suited for illuminating smaller spaces or that can be used for orientation purposes. Thus, a fluorescent lamp is known from EP-A 0,233,529 in which the connector element is configured as a plug element with plug contacts projecting from one side and electrically connected to the fluorescent lamp tube, the housing is oblong in shape and composed of two half-shells that can be separated in the axial direction, the area adjacent to the plug contacts in the plug element is molded out of the housing consisting of half-shells and the plug element is arranged on a long side of the housing and projects vertically from this long side.

The lamps made of plastic as described therein have proven themselves very well. In using them, however, it was often considered unsatisfactory that these lamps do not have an on/off switch. Furthermore, because of the manufacturing method, the fluorescent tube cannot be exchanged after its service life expires, so that the lamp is no longer usable in case of a defective fluorescent tube. This disadvantage is caused by the half-shell mode of construction, since the electrical equipment needed for operating the lamp is integrated along with the fluorescent tube into the lamp interior, and the housing consisting of the two half-shells is closed and welded shut around the electrical equipment. Even if the translucent illumination field cover is removed, the fluorescent tube cannot be exchanged, since it is rigidly integrated into the housing.

SUMMARY OF THE INVENTION

The invention is based on the task of improving the known lamp such that it can be turned on and off with a switching element, with the switching element to be integrated into the housing such that the manufacturing process of the two half-shells and the assembly of the lamp are not impaired. Furthermore, the known lamp should be improved such that the electrical equipment and the design of the housing make it possible-to exchange the fluorescent tube, if it proves defective, even without opening the housing. Finally the housing consisting of two half-shells should be configured such that the manufacturing process is further simplified, and, in particular, the assembly of the lamp and the joining and connection of the two half-shells is simplified.

In order to solve the first partial task, a lamp of the type mentioned initially has a switching element guided through the housing that can be set in the desired position by means of a catch element provided on the housing.

By means of the catch element provided on the housing the complementary part of the switching element can be integrated into the housing and molded together with the half-shells of the lamp housing. This leads to a simplification of the manufacture of the switch, since the latter now consists of only one additional switching element that cooperates with the catch element formed on the housing.

The switching element is preferably fed through both half-shells. The complementary catch element is only necessary on one of the two half-shells, but can be provided on both for reasons of manufacturing technology. The catch element cooperates with complementary elements of the switching element and thereby defines the switching positions. If catch elements are provided on both half-shells, it is practical for only one of the two catch elements to serve for defining the switching positions. The other can serve for guiding the switching element.

It is practical for the catch element to be configured as a slotted spring cage projecting into the housing. The slotted design creates the elasticity and, via resistance, the desired catch effect for alternating switching positions.

The switching element is preferably configured as a pushbutton equipped with two catch planes. The pushbutton can be an essentially cylindrical stud on which the catch planes are provided in the form of circumferential channels or grooves. The catch planes cooperate with engagement elements provided on the spring cage and projecting into the spring cage.

In order to protect the pushbutton against springing from the housing, a circumferential flange may be provided adjacent to the innermost of the two catch planes, said flange abutting against the spring cage at one end position of the pushbutton when the engagement elements of the spring cage engages with the inner of the two catch planes, and against a retaining element in the interior of the housing, which may also be present there in the form of a built-in part, the contact pins of the fluorescent tube.

In order to guarantee a rapid breaking of contact, it is practical for the sliding element to overcome a resistance when it moves from one catch position to the other. To this end, it is possible for the part of the pushbutton lying between the two catch planes to be shaped as a bead, the sides of which taper down towards the catch planes. The bead causes the engagement elements of the spring cage to experience a force acting outward during changing of the switching position, which in turn causes a spreading of the spring cage around the bead which is canceled during the sliding into the other catch plane, thus leading to a new stable seating in this catch plane. Alternatively, the part of the pushbutton between the catch planes may be shaped as a double cone that declines on both sides from its periphery, that is, the point of greatest circumference towards the catch planes. It is also possible for the double cone to be constructed asymmetrically, by shifting the periphery in the direction of one or the other catch planes, particularly to guarantee a rapid breaking of contact.

It is practical for the switching element, which is configured specifically as a pushbutton, to have an actuator for the contact member with which the electrical contact for operating the fluorescent tube is produced. This actuator may, for instance, have the form of a contact jaw, some other type of recess or a groove. A circumferential groove has the advantage that, when installing the pushbutton, there is no need to orient the latter in regard to the contact member. A contact jaw, on the other hand, permits a precise guiding of the contact member.

The contact member on which the switching element or the pushbutton acts may connect a circuit board in conventional manner to the contact pins on the fluorescent tube or to one of the plug element contacts.

It is practical for the switching element or pushbutton of the lamp according to the invention to be situated in recesses that are arranged in the half-shells of the housing. Such recesses, which may be formed as cavities, emphasize the location of the switching element, on the one hand, and prevent, on the other, an unintentional actuation of the switching element. If the recesses or cavities are arranged in the direct vicinity of the illumination field cover, they can also be used with a suitable tool, a screwdriver for instance, to pry out the illumination field cover for changing the fluorescent tube.

It is practical for the housing of the lamp according to the invention to consist of two half-shells that are produced in one piece and connected by being folded together. Apart from the advantages in manufacturing the half-shells, a configuration of the half-shells with respect to one another thus results which simplifies and eases the folding up and joining together of the housing. This also permits the housing to be joined together by simple pressing or ultrasonic welding. Other types of joints are naturally also possible and practical, by means of catch elements, for instance, which may also be joined by pressing or welding or by screw fastening.

In a one-piece half-shell construction, the housing is preferably divided axially and has the plug element, preferably molded partially out of the half-shells, on one of its long sides. In order to ease the insertion of the plug contacts into the plug element, it is practical for the division of the half-shells to be advanced into the plug element.

Plastic film hinges that can be formed immediately when manufacturing the half-shells have proven to be a particularly suitable connection of the two half-shells. In the case of a housing divided in the axial direction, these film hinges can connect the two half-shells on the side opposite the plug element, but also in the vicinity of the plug element itself. A plastic film hinge connection of the two half-shells via the bottom of the plug element has proven particularly suitable. In this embodiment, the housing consists of the two half-shells, which include the sides of the plug element and are each connected via a film hinge to the bottom of the plug element. This also permits an essentially mirror-symmetrical arrangement of the half-shells.

It is understood that the particular design of the lamp housing with connected half-shells can exist independently of the switching equipment in the lamp.

In order to make it possible or easier to exchange the fluorescent tube, it is practical for the housing to be equipped adjacent to the illumination field, in the vicinity of the separation line of the half-shells, with a slot-shaped cutout on one side and an insertion opening for the contact pins of the fluorescent tube on the other. The slot-shaped cutout in the vicinity of the illumination field runs from the outermost periphery of the lamp inward, so that the fluorescent tube can be inserted on one side with its contact pins into the insertion opening and pushed into the slot-shaped cutout from the outside on the other side.

It is advantageous in this embodiment to provide flexible ridges inside the housing for holding the fluorescent tube in its operating position. The flexible ridges hold the fluorescent tube in place in its contact position in the housing. Their resistance can be overcome by exerting a slight force on the tube in the direction of the housing exterior.

In order to improve the contact between the contact members and the contact pins of the fluorescent tube, it is practical to equip the contact members with a V-shaped profile that can lock into place with the closed end of the V in the area between the contact pins. Such a configuration of the housing, which makes the exchange of the fluorescent tube possible, has the additional advantage that holding the fluorescent tube in place in its operating position is additionally brought about by the contact members, which promotes work safety.

It is understood that the particular configuration of the housing that permits the exchange of the fluorescent tube can exist independently of the provision of a switching element or the one-part half-shell construction.

It is practical for such lamps configured according to the invention to have a translucent illumination field cover made of a suitable plastic material that can be pushed on with a tight friction fit. In order to remove the illumination field cover it may be practical to provide a recess or cavity in the housing immediately adjacent to the illumination field which makes it easier to pry the illumination field cover off with a suitable tool. This may be practical for exchanging the fluorescent tube, and also for cleaning the illumination field cover on the inside.

With regard to other possible additional configurations and embodiments of the lamp, reference is made to the aforementioned EP-A 0,233,529, and in particular to FIGS. 1–3 therein and the associated description.

BRIEF DESCRIPTION OF THE DRAWINGS

The inventions will be explained in greater detail in conjunction with the attached figures of preferred embodiments of the lamp according to the invention. It is understood that the characteristics presented there may each appear individually and in arbitrary combinations. These show

DETAILED DESCRIPTION OF THE PREFERRED EMBODIMENTS

Figure 1:
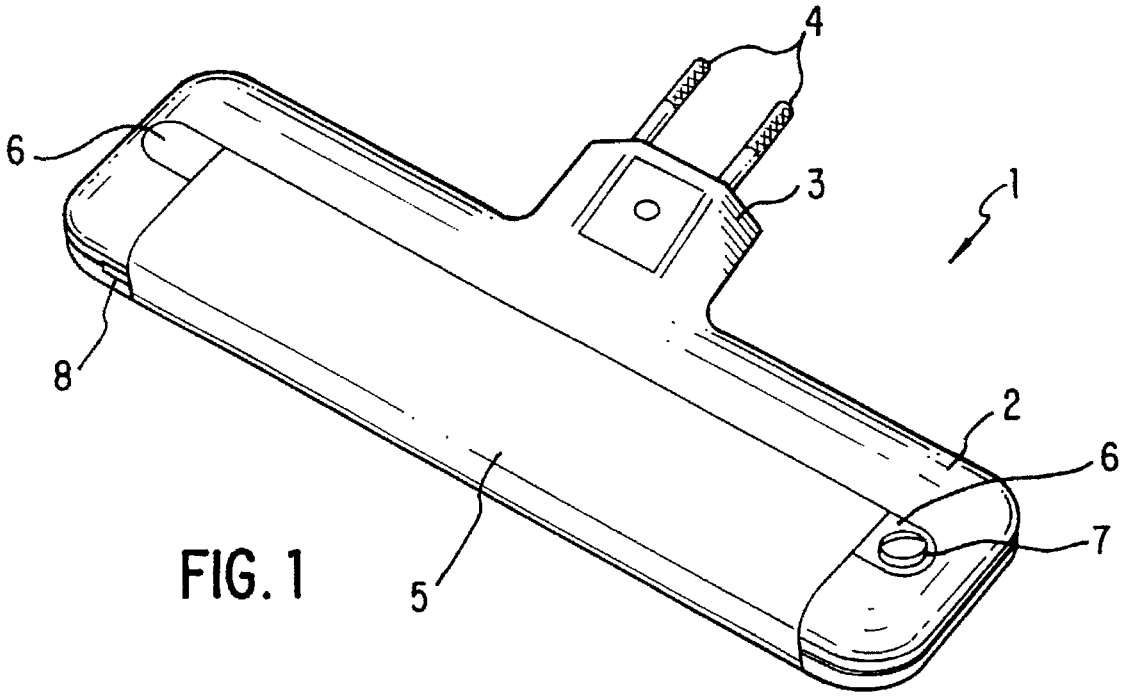
FIG. 1 shows a lamp according to the invention in a perspective representative.

FIG. 1 shows a lamp 1 according to the invention in a perspective view. The lamp itself consists of a lamp housing 2 with molded-on plug element 3 and plug contacts 4. The illumination field with the fluorescent tube, not shown, is enclosed by a slip-on transparent illumination field cover 5. The illumination field cover extends around the part of the housing 2 opposite the plug element 3, and forms part of the upper part as well as the lower part of the lamp 1. Two cavities located in the area of the base line of the illumination field cover 5 laterally in the housing 2 of lamp 1 serve differing purposes: in one of the cavities there is a pushbutton 7 for turning the lamp on and off; the other cavity serves as an application point for a tool with which the illumination field cover 5 can be pried loose from the housing 2 and removed, in order to change the fluorescent tube underneath. Also serving for changing the fluorescent tube is the slot-shaped cutout 8, which extends under the illumination field cover 5 into the interior of the lamp, and into which the contact pins of one side of a fluorescent tube can be inserted.

Figure 2:
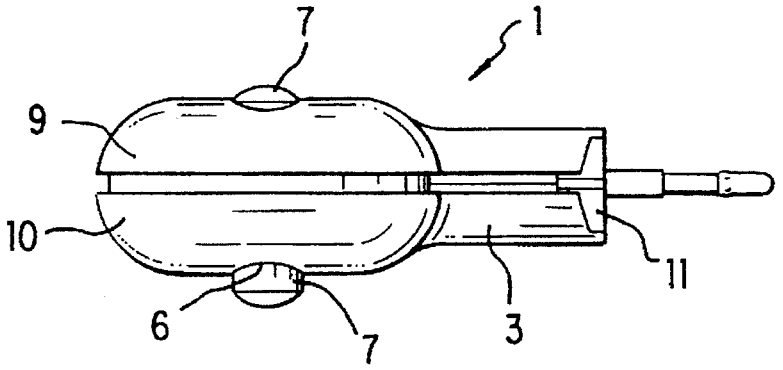
FIG. 2 shows the lamp of FIG. 1 in a lateral top view.

FIG. 2 shows the lamp 1 from FIG. 1 in a side view, with the construction of the housing 2 from an upper half-shell 9 and lower half-shell 10 clearly dicernible. The half-shell construction continues into the plug element 3 and end at its bottom area 11, which does not belong to either of the two half-shells 9 and 10. The pushbutton 7, located in the cavity 6 which is also indicated, is guided through the half-shells 9 and 10. The pushbutton is brought into the respective other position by being pressed inward from the upper or lower side.

Figure 3:
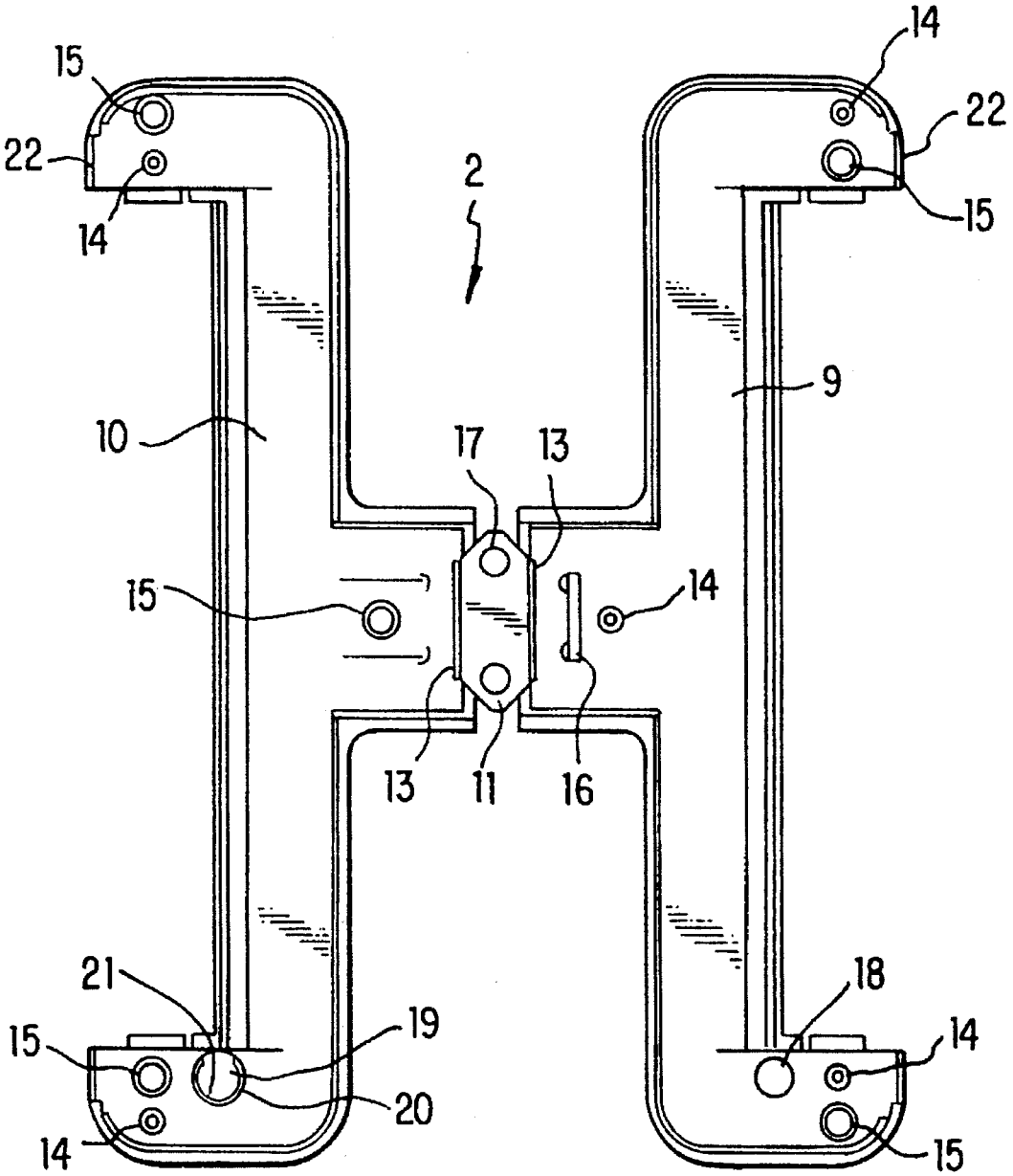
FIG. 3 shows an embodiment of a lamp according to the invention with half-shells folded out.

FIG. 3 shows a top view of the of the housing 2 of a lamp 1 with half-shells 9 and 10 folded out. The view of the inside is shown. The two half-shells 9 and 10 are connected via the bottom 11 of the plug element, with the connections being formed by film hinges 13. All together, the plug element 3 consists of the bottom 11 and the two parts of the half-shells 9 and 10 held adjacent by the hinges 13 and folded together in the finished housing.

According to the illustrated embodiment, the two half-shells and 10 are held together in the folded state by catch elements, the positive element 14 of which engages with negative elements 15 and are locked in place there. Two ridges 16 serve to hold in place the plug contacts, which extend out of the housing through the openings 17 in the plug element bottom 11.

Two complementary holes 18 and 19 in the half-shells 9 and 10 serve to house and guide the switching element 7. The hole 19 is constructed as a catch element or a spring cage due to the fact that it has a concentrically running wall 20 on its inside that is divided up by slits. A projection 21 running part way around the circumference of this wall 20 is able to exert a locking effect on the catch positions provided in the complementary switching element, thereby defining the switch positions. The projection 21 may also be constructed in the form of several catch tongues.

Complementary recesses 22 on the edge area of the front side of the half-shells 9 and 10 create a slot-shaped cutout 8 in the assembled housing, into which the contact pins of one side of a fluorescent tube 12 can be inserted. The contact pins on the other side of the fluorescent tube are inserted into suitable openings on the opposite side of the housing in the vicinity of the illumination field. The illumination field is defined by the rectangular cutout in the housing half-shells opposite the plug element bottom 11.

Figure 4:
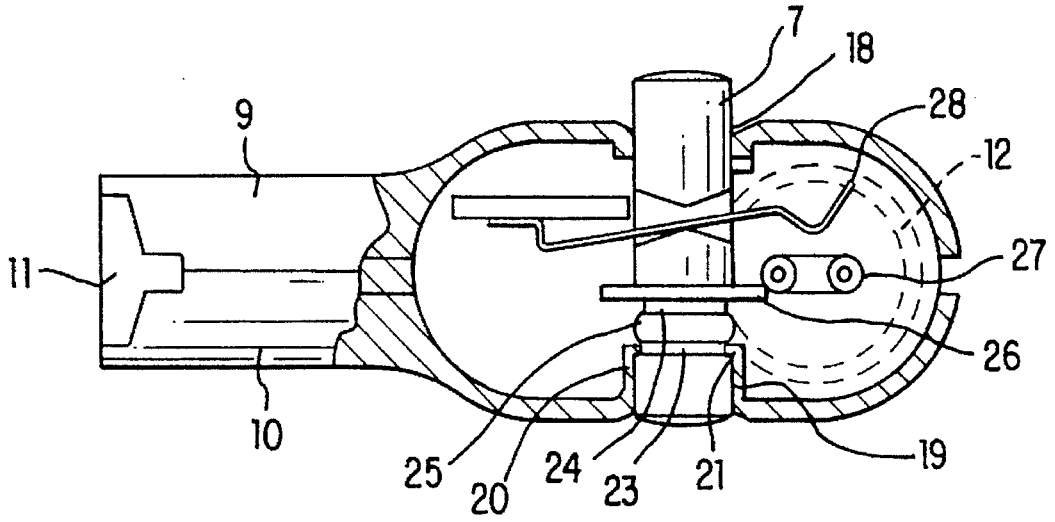
FIGS. 4 & 5 show cross sections of a lamp according to the invention with switching element in the off and on positions respectively.
Figure 5:
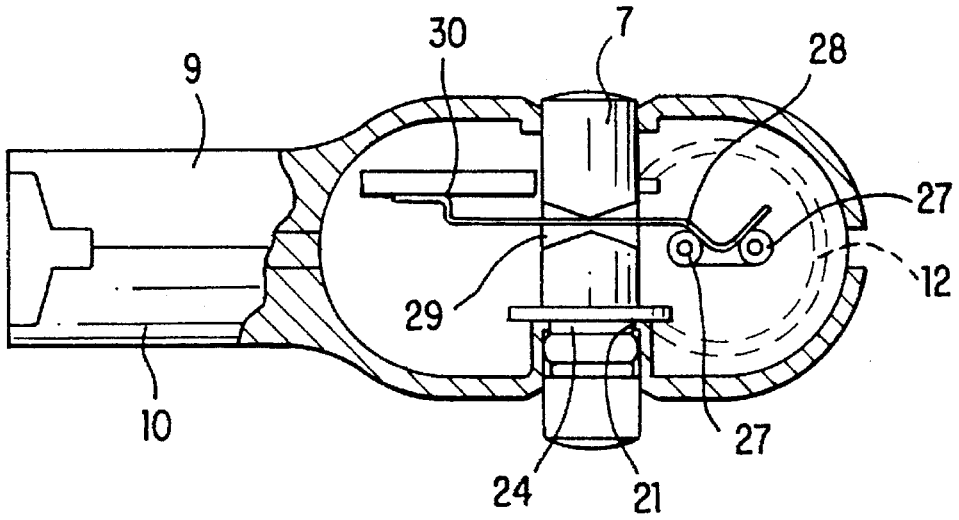

FIGS. 4 and 5 show a section through a lamp according to the invention in the area of the hole 18 and the catch element 19. Clearly recognizable is the structure of the spring cage 19, which is molded out of the lower half-shell 10 and equipped with a circumferential wall 20, the slits in which are not shown here. On its inside, the wall 20 has a partially circumferential projection 21, which acts as an elastically seated catch tongue that engages with the corresponding groove 23 or 24 in the pushbutton 7. The change of switching positions between the catch planes or grooves 23 and 24 is eased by the fact that the intermediate part 25 of the pushbutton 7 is formed as a bead 25, which, together with the spring cage 19, produces the resistance required for a reliable changeover.

A circumferential projection or flange 26 around the pushbutton 7 adjacent to the inner catch plane or groove 24 assures the safe seating of the pushbutton 7, so that the latter cannot be pressed beyond the inner catch position 24 into the spring cage 19. In the opposite switch position, in which the projection 21 of the spring cage 19 engages with the outer catch plane 23, the projection 26 is supported against the pin contacts 27 of the fluorescent tube 12 or against a suitable element inside the housing 2, not shown here. As shown in FIGS. 4 and 5, the stud 7 has an actuator 29 in its central area for a contact member 28, with which the electrical contact between circuit and contact pins 27 of the fluorescent tube 12 is produced. It is practical for the actuator 29 to have the form of a contact jaw that lifts the contact member 28 off the contact pins 27 of the fluorescent tube 12 in the off position of the pushbutton 7 shown in FIG. 4 (the catch plane 23 of the pushbutton 7 cooperates with the projection 21 of the spring cage 19), and-in the other switching position, shown in FIG. 5, pushes the contact member 28 against the contact pins 27 of the fluorescent tube 12 (the inner catch plane 24 of the pressbutton 7 cooperates with the projection 21 of the spring cage 19. As illustrated, it is practical for producing a good contact between contact member 28 and contact pins 27 to provide the contact member 28 with a V-shaped impression that extends between the two contact pins 27. It should also be remarked that the contact member 28 is attached to a circuit board 30 running along the housing 2 and carrying a circuit typical of such a lamp.

Figure 6:
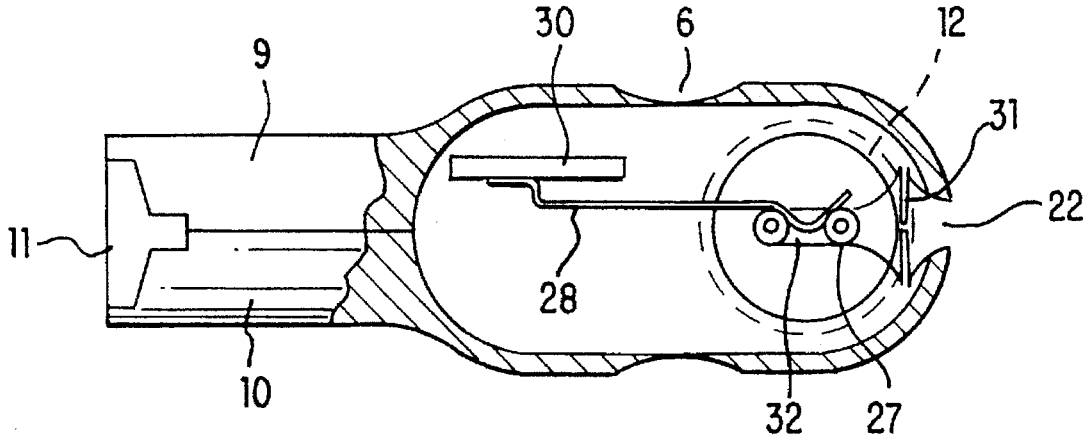
FIGS. 6 & 7 show a section through a lamp according to the invention in the vicinity of the contact pins of the fluorescent tube with inserted and partially inserted fluorescent tube.
Figure 7:
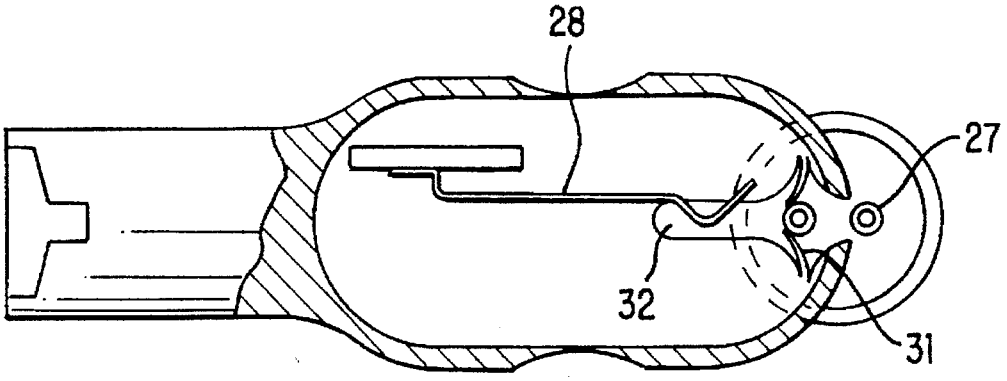

FIGS. 6 and 7 show a section through a lamp according to the invention with half-shells 9 and 10 pressed together in the vicinity of the contact pins 27/contact member 28 on the housing side opposite the switching element 7. Recesses 22 of half-shells 9 and 10 which define the slot-shaped cutout 8 shown in FIG. 1 are recognizable. These recesses 22 of the half-shells are continued inward in a bushing 32 which houses the contact pins 27 of the fluorescent tube. Between the bushing 32 and cut backs 22 there are flexible ridges 31 that project from above and below into the bushing path. The resistance of these flexible ridges 31 must be overcome when pulling the contact pins 27 out of the bushing 32, as well as when inserting a new fluorescent tube 12, as shown in FIG. 7. It is also visible in FIG. 6 that the contact member 28 with its stamped V-shape is suited to hold the contact pins 27 of the fluorescent tube 12 in their operating position and to prevent slippage from the slot-shaped cutout 8. As FIG. 7 shows, the contact pins 27 of the fluorescent tube press the flexible ridges 31 apart when being inserted so that the path into the bushing 32 becomes free. Behind the contact pins 27, the ridges 31 reassume their original position when the tube has reached its operating position.

Figure 8:
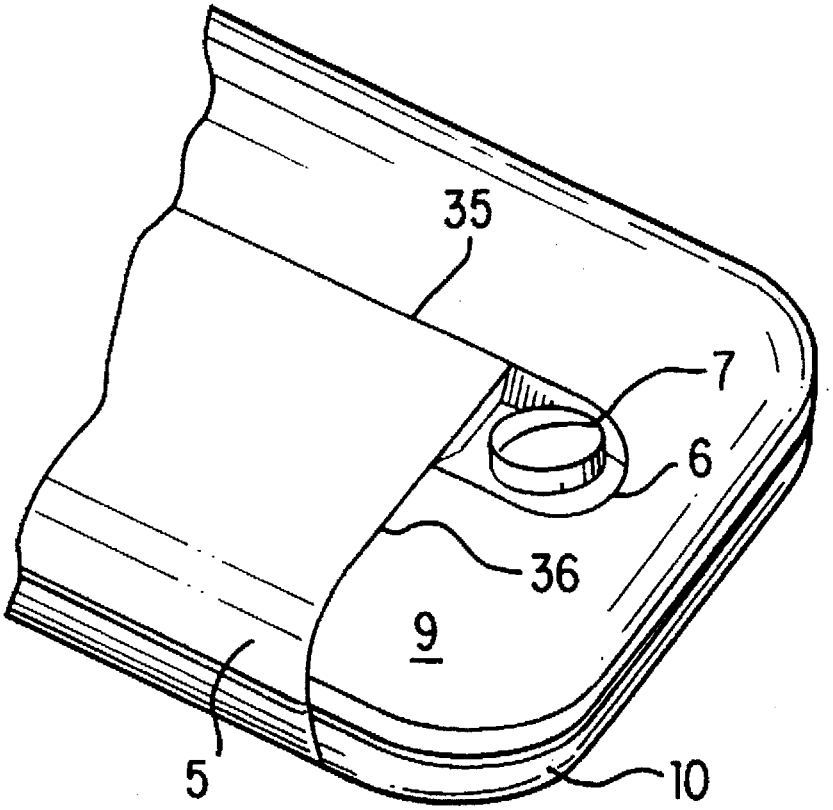
FIG. 8 an enlarged cutout of a lamp according to the invention in the vicinity of the switching element.

FIG. 8 shows an enlarged cross section of the surroundings of the pushbutton of the lamp in FIG. 1. The pushbutton 7 is arranged inside a recess or cavity 6, which is suited on the one hand to make the pushbutton 7 stand out visually and, on the other, to protect it from damage. In particular, the pushbutton sunk into the recess permits protection against unintentional actuation.

The recess 6 with the pushbutton 7 is arranged immediately next to the illumination field cover 5. The illumination field cover 5 has an elongated U-shape overall and is snapped onto the assembled housing 2 with its free arms 35, and is held in place there by a friction fit in corresponding recesses in the housing half-shells 9 and 10. The recess 6, which has a counterpart in the half-shell of the housing 2 beneath it, in which the other end of the pushbutton 7 is seated, as well as preferably two additional counterparts on the opposite side of the illumination field cover 5 (without a pushbutton) makes it possible to apply a tool for prying up and removing the illumination field cover in the vicinity of the lateral edges 36.

Figure 11:
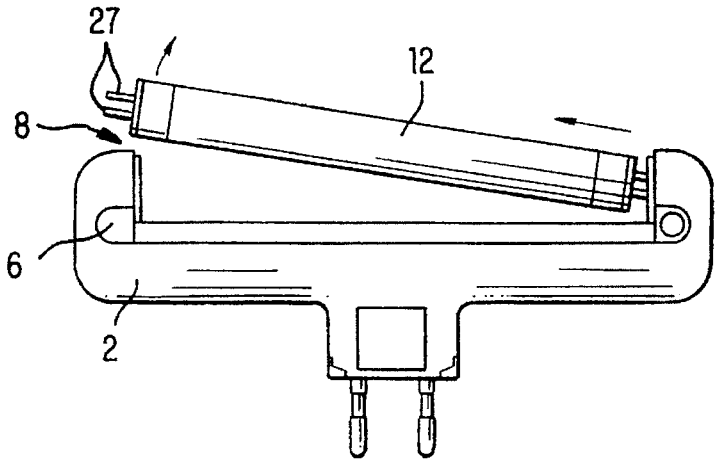
FIGS. 9–11 the work steps required for exchanging a fluorescent tube.
Figure 10:
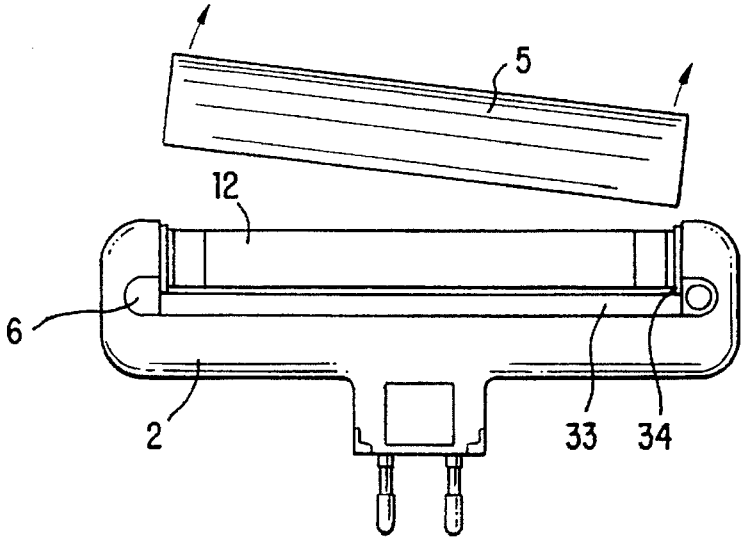
Figure 9:
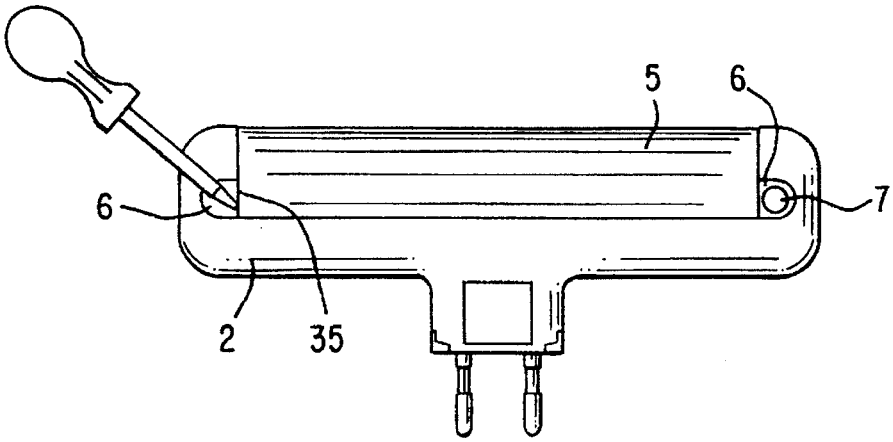

FIGS. 9–11 schematically illustrate the work steps for exchanging the fluorescent tube 12. First of all (FIG. 9) one pushes a screwdriver in one of the recesses 6 under the lateral edge 36 of the illumination field cover 5 to free it from its friction fit with the housing 2. This makes it possible to pull the illumination field cover 5 of the housing 2. [incomplete sentence in original] the recess 33 in housing 2, which serves as a seat for the lateral edge 35 of the illumination field cover 5 and the lateral profiles 34 which support the U-shaped profile in the vicinity of the lateral edges 36. FIG. 11, finally, shows the removal of the fluorescent tube 12, which is pulled out of the housing 2 at one end with its contact pins 27 through the slot-shaped cutout 8 (position indicated by the arrow). In a second step, the contact pins are pulled out at the opposite side in a direction of motion perpendicular to the first tensile direction. On this side there is no slot-shaped cutout 8, but only insertion openings matched to the dimensions of the contact pins 27.

Figure 12:
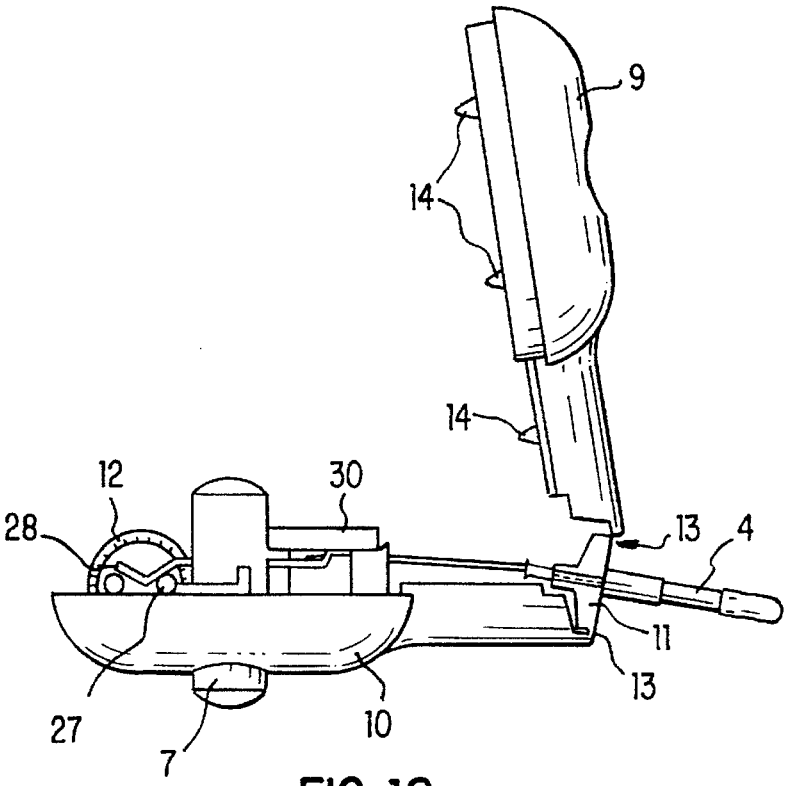
FIG. 12 a lamp according to the invention folded halfway open with electrical equipment present in it and with inserted fluorescent tube.
Figure 13:
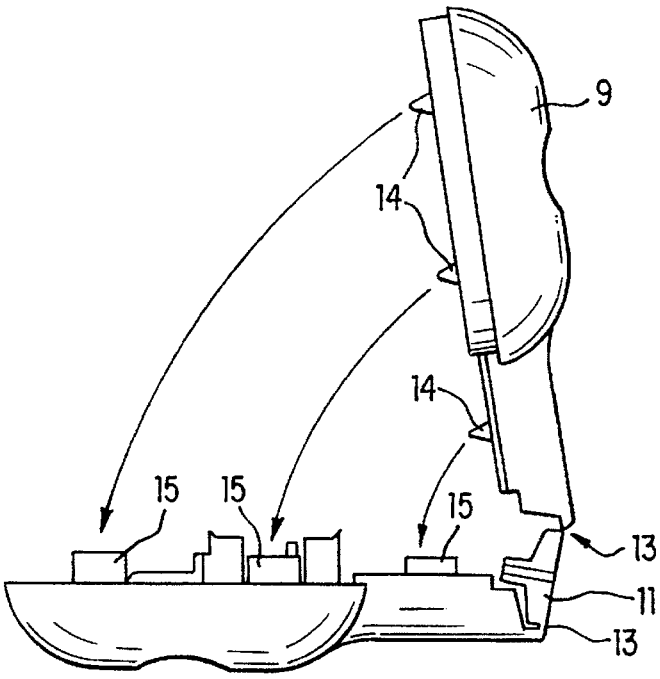
FIG. 13 the lamp housing of a lamp according to the invention folded halfway open.

FIG. 12 shows a lamp according to the invention with pushbutton 7, fluorescent tube 12 and the electrical equipment. Also visible is the contact member 28 with V-shaped end, which is seated on the circuit board 30 and produces a conductive connection with the contact pins 27 of the fluorescent tube 12. In the vicinity of the upper half-shell 9 there are catch pins 14 that engage with complementary negative catch elements 15 of the lower half-shell 10 (see FIG. 13). Also clearly recognizable in FIG. 12 and 13 is the joining of the two half-shells 9 and 10 by means of film hinges 13 to the bottom 11 of the plug element, through the contact openings of which the line contacts 4 are pushed. It is practical to connect the line contacts 4 via plug connections to the electrical equipment in the lamp interior.

Figure 14:
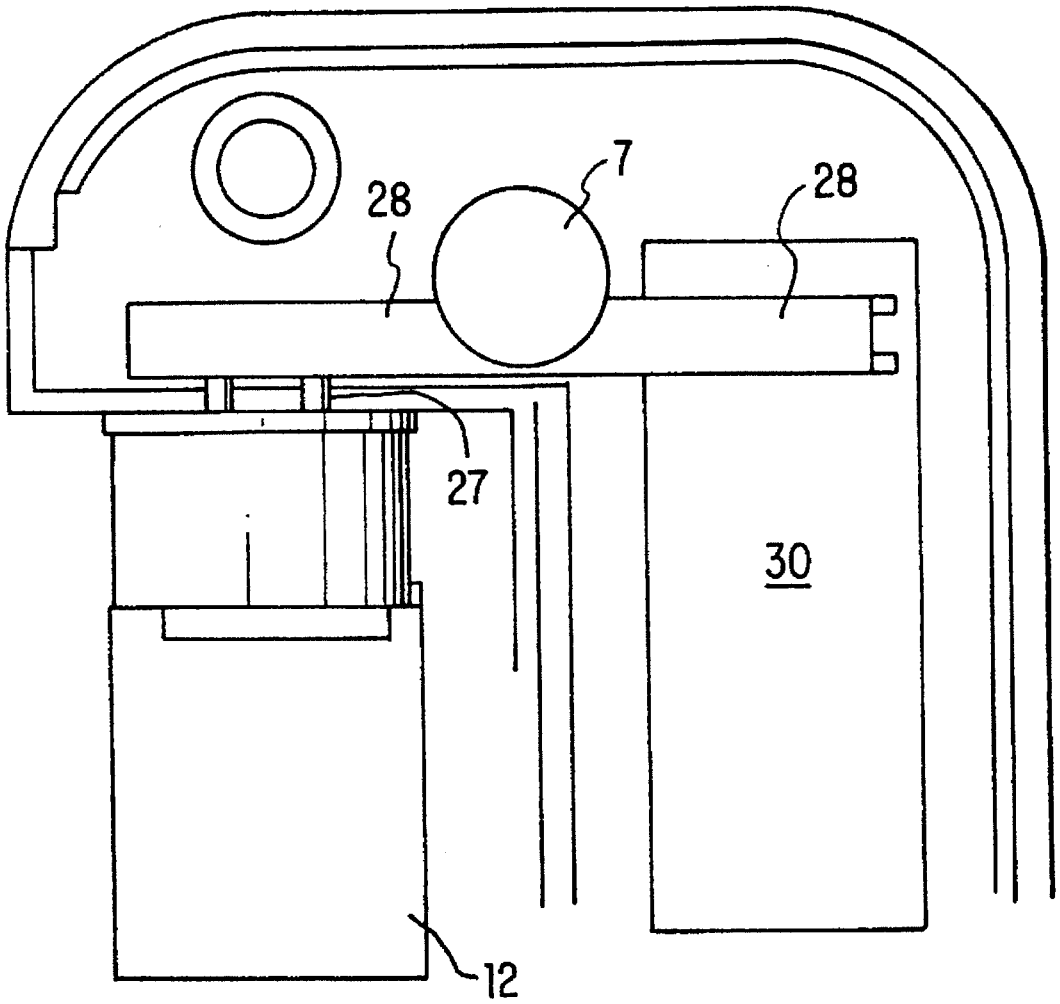
FIG. 14 interrelations between pushbutton, contact member and contact pins of the fluorescent tube.

FIG. 14 shows a partial view of a half-shell of a lamp according to the invention with the fluorescent tube 12. The contact pins 27 of the fluorescent tube 12 are connected via the flexible contact member 28 to the circuit board 30. The contact member 28 runs on its path from the contact pins 27 to the circuit board 28 [sic; 30]through a groove to contact scissors of the pushbutton 7, so that it is entrained by the latter's movement up and down and in the process makes and breaks the contact to the contact pins 27.

Figure 15:
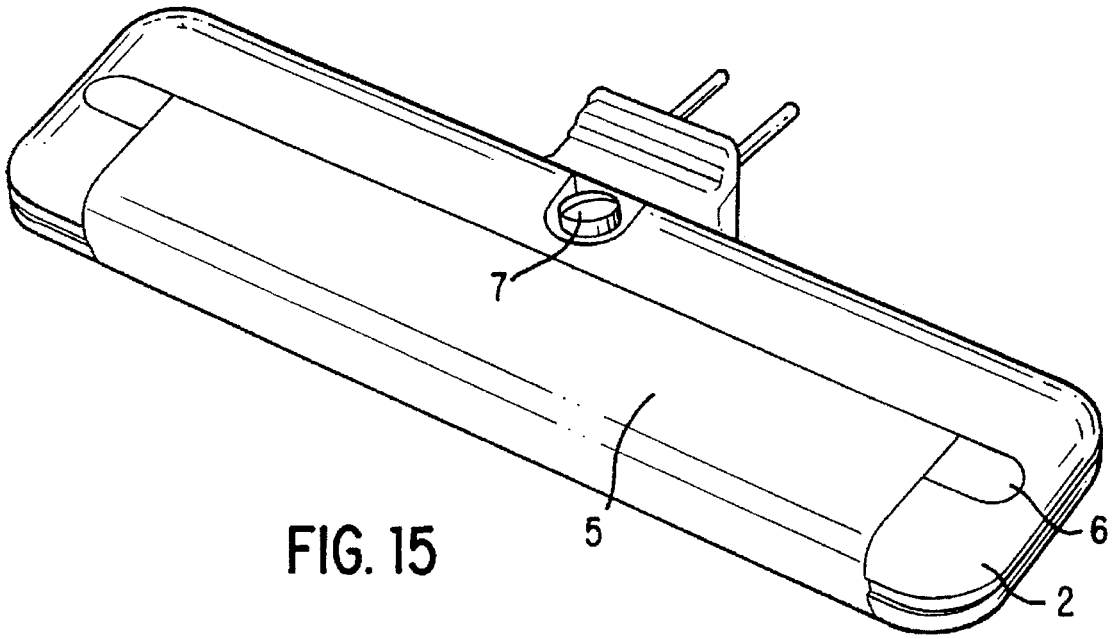
FIG. 15 an alternative embodiment of with arrangement of the pushbutton in the vicinity of the plug element.

FIG. 15 shows an alternative arrangement of the pushbutton 7 in the housing 2 of lamp according to the invention in the vicinity of the shoulder of the plug element 3, as is especially suitable for the U.S. market. In this case as well, the switching element 7 is arranged in a recess or cavity that serves to protect it. The recesses 6 arranged at the sides of the illumination field cover 5 serve for opening and pulling off the illumination field cover 5.

Figure 16:
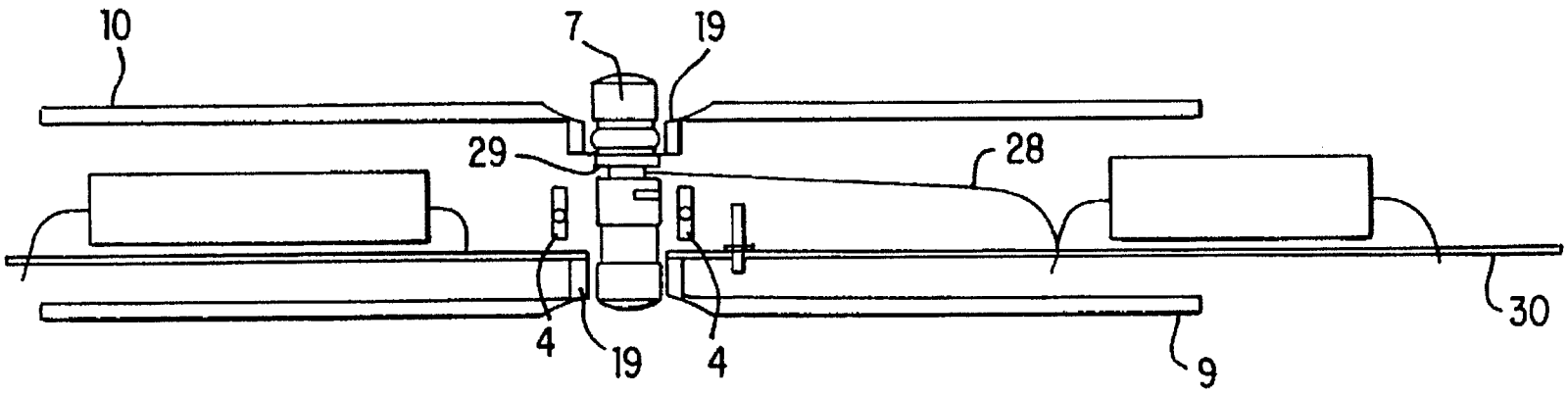
FIGS. 16 & 17 the wiring of the switching element of a lamp according to FIG. 15.
Figure 17:
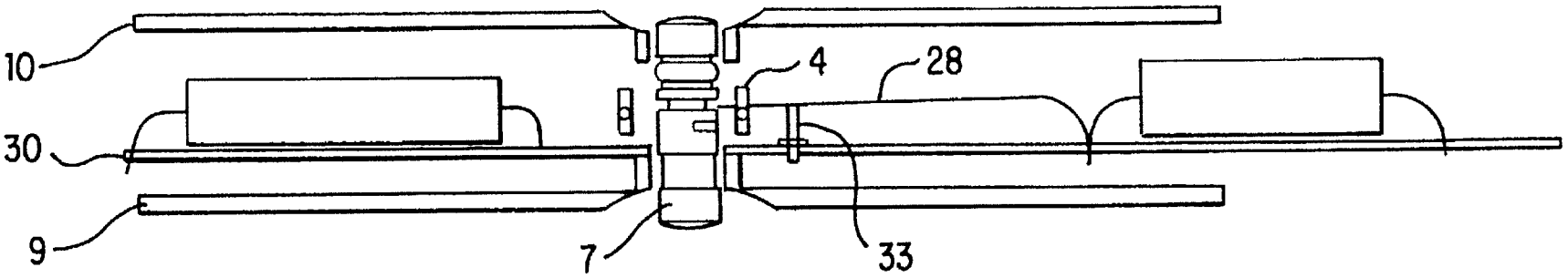

FIGS. 16 and 17 show the mode of operation of the pushbutton 7 when arranged according to FIG. 15. The pushbutton 7 lies between the plug contacts 4 roughly in the middle of the housing and is guided and retained in the half-shell 10 by the spring cage 19. An additional spring cage 19 in the other half-shell 9 serves only to guide the pushbutton 7, but has no influence on switching. The configuration of the pushbutton 7 is as shown in FIGS. 4 and 5, but differs in that instead of the contact jaw, a groove 29 is present in which the contact member 28 is guided. The circumferential groove 29 has the advantage that the pushbutton need not be positioned during installation in regard to the contact member 28 and need not be protected against torsion.

One of the two plug contacts 4 which comes into electrical contact in the on position with the contact member 28—see FIG. 17—serves as the contact point in this embodiment. A contact pin 33 serves a spacer pin.

Figure 18:
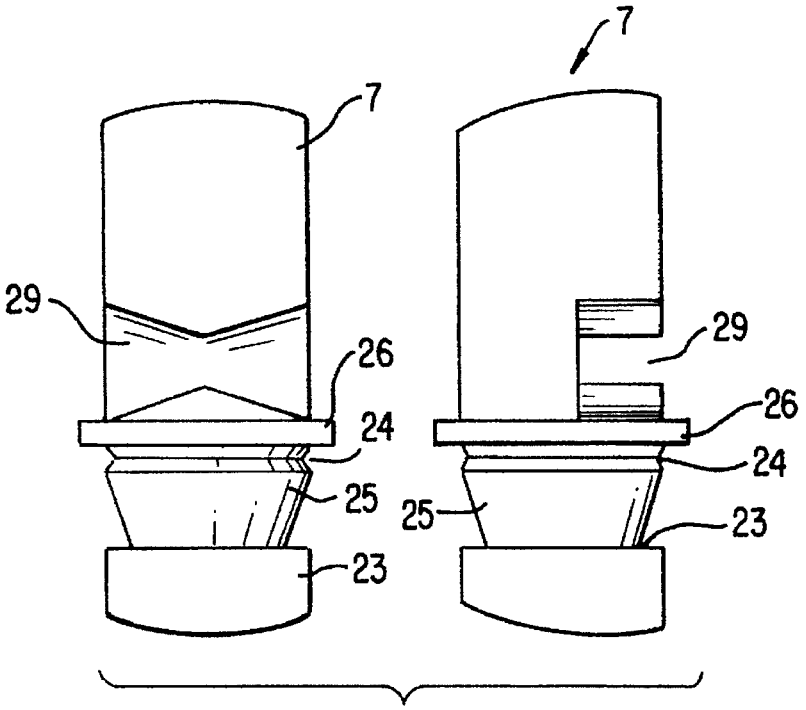
FIG. 18 an alternative embodiment of a switch applied according to the invention.

FIG. 18 shows a front and side view of an additional embodiment of a pushbutton being employed according to the invention. The pushbutton 7 is configured as a cylindrical pin that has a contact jaw 29 in its central area which is delimited by a flange 26 against the inner catch plane 24. An outer catch plane 23 is further recessed with respect to the inner catch plane 24 so that, in conjunction with the effect of a spring cage 19, a pressure builds up when the catch plane 24 is occupied which indicates the on position. The part located between the catch planes 23 and 24 is shaped as a double cone 25, the periphery of which is immediately adjacent to the inner catch position 24 and declines only slightly there. A sharper decline of the cone wall occurs towards the outer catch position 23. This makes a quick breaking of contact possible when there is a change from the on position 24 to the off position 23, since the pressure on the spring cage 19 diminishes towards the outer catch position 23 and supports the switching motion.

With regard to additional details of the configuration of a lamp according to the invention with conventional components, reference is made to EP-A 0,233,529.

Figure 19:
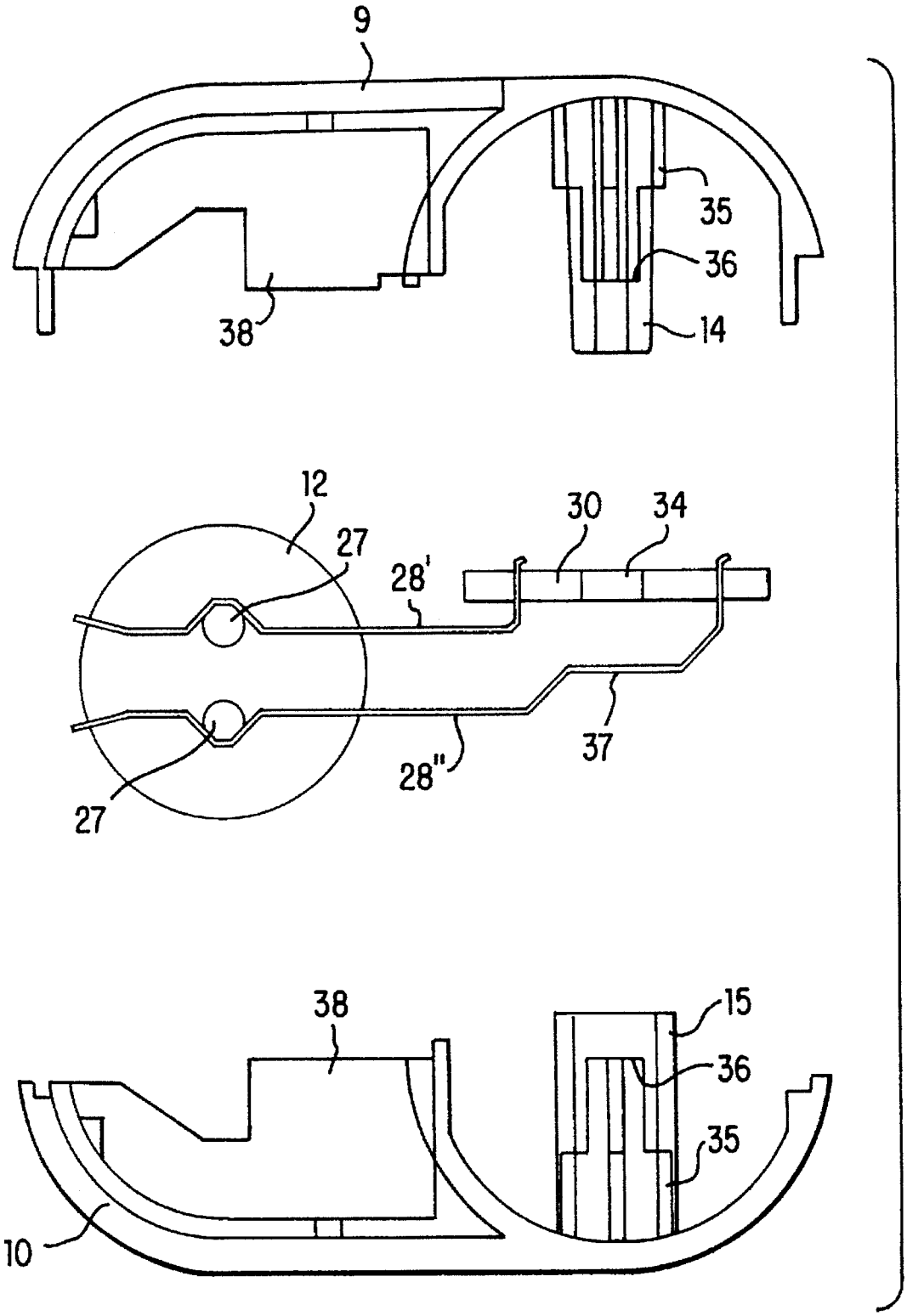
FIG. 19 an embodiment of the invention with two contact members on each side of the fluorescent tube.

FIG. 19 shows the individual components of a lamp according to the invention as already described in FIGS. 15–18, with a pushbutton arranged in the area of the shoulder of the plug element. In addition to the catch elements 14 and 15, the two half-shells 9 and 10 have positioning pins 35 arranged in front of the latter with a cross-shaped profile and a stepwise recession towards their tips 36. These positioning pins are arranged-in both half-shells such that they point exactly at one another with the half-shells assembled.

Shown between the two half-shells is the board 30, which has a central cutout 34 as well as two contact members 28', 28" that are pushed through the board 30 and anchored in it. The two contact members 28', 28" have a V-shaped notch which is matched in dimension to the contact pins 27 of a fluorescent tube 12 and surround and clamp these contact pins in their V-shaped section. With the half-shells 9 and 10 assembled, the fluorescent tube 12 is additionally mounted in guides 38 running across the half-shells 9 and 10. The contact members 28' and 28" are of different lengths due to their differing positioning on the board 30, and in the area where they are mounted they have an angled off section which is pushed through the board and held in position by being bent over on the rear side of the board. The longer of the two contact members 28" additionally has an area 37 which is set back with respect to the overall profile and lies in the plane that separates the two half-shells 9 and 10 of the lamp according to the invention. This section 37 which is set back with respect to the overall profile of the contact member 28" is found where the contact member 28" runs beneath the cutout 34 in the board and serves for additional support. Since the board 30 with the cutout 34 is pushed onto the recessed part 36 of the positioning pin 35, the end 36 of the positioning pin 35 makes contact with the contact member 28" in the area 37. If the second half-shell 10 is pushed together with the other half-shell 9, then part 37 with contact member 28" moves between the two recessed ends 36 of the positioning pins 35 and is held in this position. To this end it is necessary that the two positioning pins 35 leave a free space between their ends 36 that matches the thickness of the contact member 28" in the area 37.

It is understood that the contact members 28' and 28" respectively are ordinary shaped sheet metal strips made on an electrically conductive material and matched in their dimensions to the dimensions of the contact pins 27.

I claim:

1. Lamp for fluorescent tubes comprising:

a plastic housing (2) comprising two half-shells (9,10) that can be divided laterally, a plug element (3) molded out of the housing, an illumination field having an optional illumination field cover (5), and electrical equipment for operating a fluorescent tube (12), the lamp having a switching element (7) guided through the housing (2), the switching element being held in a desired switching position by a catch element (19) provided on the housing (2), the catch element comprising a slotted spring cage projecting into the housing.

2. Lamp according to claim 1, characterized in that the switching element (7) is guided through both half-shells (9,10).

3. Lamp according to claim 1, characterized in that the switching element comprises a pushbutton (7) having two concentric and parallel catch planes (23,24) which cooperate with engagement elements (21) provided on the spring cage (19) and which catch planes project into the spring cage (19), defining two switching positions.

4. Lamp according to claim 3, characterized in that the pushbutton (7) has a circumferential flange (26) adjacent to an inner catch plane (24).

5. Lamp according to claim 3, characterized in that a part of the pushbutton (7) lying between the two catch planes (23,24) is constructed as a bead (25), sides of which run down towards the catch planes (23,24).

6. Lamp according to claim 3, characterized in that a part of the pushbutton (7) lying between the two catch planes (23,24) is constructed as a double cone (25) which tapers the catch planes (23,24).

7. Lamp according to claim 6, characterized in that the double cone (25) is constructed asymmetrically such that a short and a long slope towards the two catch planes (23,24) result.

8. Lamp according to claim 3, characterized in that the pushbutton (7) has an actuator (29) for a contact member (28) in the form of a contact jaw.

9. Lamp according to claim 3, characterized in that the pushbutton (7) has an actuator (29) for a contact member (28) in the form of a recess.

10. Lamp according to claim 8, characterized in that the contact member (28) connects a circuit board (30) to contacts (27) of a fluorescent tube (12) or to a plug connector contact (4).

11. Lamp according to claim 1, characterized in that the switching element (7) is arranged in a recess (6) of the housing (2).

12. Lamp according to claim 1, characterized in that the two half-shells are connected so as to be folded together.

13. Lamp according to claim 12, characterized in that the housing is divided in an axial direction and the plug element (3) is molded at least in part from the half-shells (9,10) on a long side.

14. Lamp according to claim 12, characterized in that the two half-shells (9,10) are connected by means of plastic film hinges (13).

15. Lamp according to one of claim 14, characterized in that the half-shells (9,10) are connected at a bottom area (11) of the plug element (3).

16. Lamp according to claim 10, characterized in that the housing (2) has at least one slot-shaped cutout (8) in an area of the separating line of a two half-shells (9,10) for inserting the contacts (27) of the fluorescent tube (12).

17. Lamp according to claim 16, characterized in that the housing (2) has the slot-shaped cutout (8) on one side adjacent to the illumination field in the area of the separating line of the half-shells (9,10) and, on the other side, an insertion opening for the contacts (27) of the fluorescent tube (12).

18. Lamp according to claim 16, characterized in that the housing (2) has flexible ridges (31) for holding the fluorescent tube (12) in place in its operating position and also for blocking off the slot-shaped cutout (8) on an insertion side.

19. Lamp according to claim 1, characterized in that the lamp has contact members (28, 28', 28") with a V-shaped profile which cooperate with contact pins (27) of the fluorescent tube (12) and bring about a securing of the fluorescent tube (12) in its operating position.

20. Lamp according to claim 19, characterized in that one contact member (28',28") is provided for each contact pin (27) of the fluorescent tube (12).

21. Lamp according to claim 1, characterized by a translucent illumination field cover (5).

22. Lamp according to claim 21, characterized in that, in an area directly adjacent to the illumination field cover (5), the housing (2) has at least one recess (6) that facilitates opening of the illumination field cover (5).

23. Lamp according to claim 1, characterized in that the half-shells (9,10) are held together by pressing or welding.

24. Lamp according to claim 1, characterized in that the catch element (19) is molded out of at least one of the two half-shells (9,10).

* * * * *